US006217239B1

(12) United States Patent
Orita et al.

(10) Patent No.: US 6,217,239 B1
(45) **Date of Patent: *Apr. 17, 2001**

(54) TEMPERATURE CONTROL APPARATUS

(75) Inventors: Hiroshi Orita, Saitama; Minoru Suzuki, Tochigi; Hiroyuki Saito, Saitama; Katsuyoshi Suzuki; Koichi Furusawa, both of Tokyo, all of (JP)

(73) Assignee: Asahi Kogaku Kogyo Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,422

(22) Filed: Mar. 24, 1999

(30) Foreign Application Priority Data

Mar. 25, 1998 (JP) ..... 10-096590

(51) Int. Cl.[7] ..... B41J 2/315

(52) U.S. Cl. ..... 400/120.01; 400/120.02; 400/120.14; 347/171; 347/172; 347/191; 347/194

(58) Field of Search ..... 400/120.01, 120.02, 400/120.14; 347/194, 191, 171, 172, 5, 17

(56) References Cited

U.S. PATENT DOCUMENTS

| | | | | |
|---|---|---|---|---|
| 4,399,209 | | 8/1983 | Sanders et al. | 430/138 |
| 4,440,846 | | 4/1984 | Sanders et al. | 430/138 |
| 4,644,376 | | 2/1987 | Usami et al. | 503/215 |
| 4,990,931 | * | 2/1991 | Sato et al. | 346/1.1 |
| 5,072,245 | * | 12/1991 | Tamura et al. | 346/76 H |
| 5,083,137 | * | 1/1992 | Badyal et al. | 347/14 |
| 5,132,709 | * | 7/1992 | West | 347/194 X |
| 5,223,853 | * | 6/1993 | Wysocki et al. | 347/14 |
| 5,246,811 | * | 9/1993 | Higuchi | 430/138 |
| 5,546,112 | * | 8/1996 | Hunter et al. | 347/171 |
| 5,563,635 | * | 10/1996 | Kneezel et al. | 347/12 |
| 5,736,995 | * | 4/1998 | Bohorquez et al. | 347/14 |
| 5,825,985 | | 10/1998 | Asai et al. | 395/108 |
| 5,879,254 | * | 4/1999 | Tanaka et al. | 400/120.07 |

FOREIGN PATENT DOCUMENTS 4-4960 1/1992 (JP) .

* cited by examiner

*Primary Examiner*—John S. Hilten
*Assistant Examiner*—Minh Chau
(74) *Attorney, Agent, or Firm*—Greenblum & Bernstein, P.L.C.

(57) ABSTRACT

A temperature control apparatus for controlling a temperature of a heating resistor included on a thermal head of a printer. The temperature control apparatus includes a sensing circuit for sensing the temperature of the heating resistor from a current flowing through the heating resistor. The temperature control apparatus includes a switching device for switching the current activated by a status signal, and a holding circuit, which holds the status signal indicating whether each heating resister is to be heated. The holding circuit is cleared when the temperature exceeds a predetermined threshold value.

14 Claims, 8 Drawing Sheets

TEMPERATURE CONTROL APPARATUS

BACKGROUND OF THE INVENTION

1. Field of the Invention

The present invention relates to a temperature control apparatus for controlling a heating temperature of a thermal head utilized in a recording apparatus, such as a high-resolution printer.

2. Description of the Related Art

An ink is known that includes fine capsules, such as micro-capsules, filled with heat-sensitive color developing dye or ink for high-resolution printing in a high resolution color printer. A recording sheet consists of a base sheet with a layer of the micro-capsules covering the base sheet. The layer of micro-capsules includes a plurality of types of micro-capsules, each type corresponding to a specific color, which seeps from the micro-capsule onto the recording sheet when the corresponding micro-capsule is heated to a predetermined temperature. The predetermined temperature varies dependent on the type of micro-capsule. Each seeped color is developed and fixed by light of a predetermined wavelength, which also varies dependent on the type of micro-capsule. Therefore, each type of micro-capsule seeps a predetermined color when heated to the predetermined temperature, and the seeped color is developed and fixed on the base sheet of the recording sheet by irradiation with the light of the specific wavelength. Thus, ink or dye of a full-color image, to be recorded on a recording sheet, can be controlled through selective breakage of the micro-capsules as seepage of the dye or ink, which occurs through control of a localized heating and irradiation with a specific wavelength of light.

The recording process utilizing the recording sheet with the layer of the micro-capsules is complicated and time-consuming as the localized heating and light irradiation must be repeatedly executed in order to develop and fix a plurality of colors.

In a printer for producing pixels via a thermal head having one or more heating elements, it is necessary to control a heating temperature of the heating elements through a time controlled application of the electric current. Usually, the heating temperature is measured by a thermistor or another type of temperature sensor. However, due to a small-size of the printer the direct measurement is difficult as the heating elements are extremely small. In this case, the temperature of the heating element cannot be directly measured and is estimated from a resistance of a thermistor disposed adjacent to the heating element within the thermal head. The temperature measured is an ambient temperature of a peripheral area around the heating element.

Due to the temperature not being directly measured, the heating temperature is inaccurate, and the printing quality of the printer, using the thermal head, is thus limited.

SUMMARY OF THE INVENTION

Therefore, an object of the present invention is to provide a temperature control apparatus for controlling the heating temperature of the thermal head when utilized in a recording apparatus.

A temperature control apparatus according to the present invention controls a heating element according to a current flowing through the heating element.

Preferably, the current flowing through the heating element is switched by a switching device, an analog signal indicative of the current is compared to a threshold value by a comparator, and the switching device is controlled according to a result of the comparison.

When a plurality of heating elements is provided, each heating element is independently and accurately controllable by the temperature control apparatus according to the present invention through a direct temperature measurement.

BRIEF DESCRIPTION OF THE DRAWINGS

The present invention will be better understood from the description of the preferred embodiments of the invention set forth below together with the accompanying drawings, in which.

DESCRIPTION OF THE PREFERRED EMBODIMENTS

Hereinafter, the preferred embodiment of the present invention is described with reference to the attached drawings.

Figure 1:
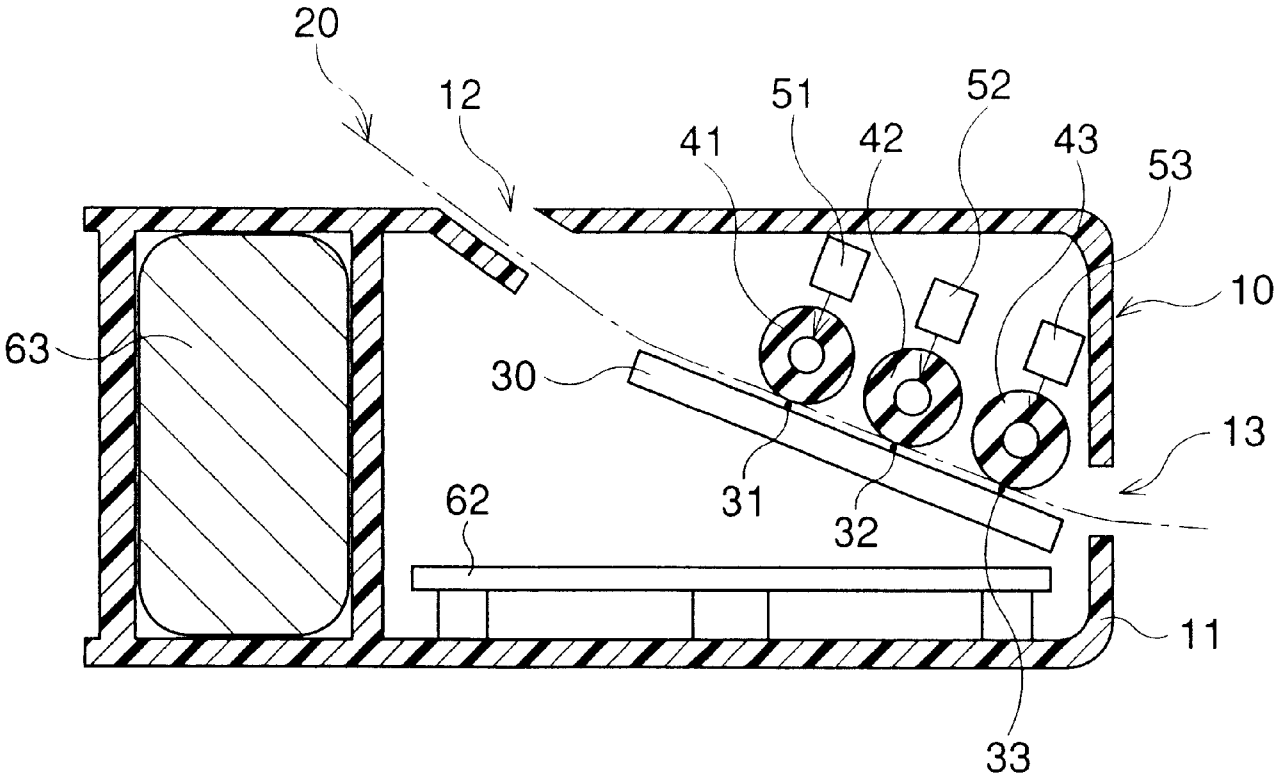
FIG. 1 is a cross-sectioned elevational view showing a high-resolution printer for pressure-sensitive and temperature-sensitive recording using an embodiment of a temperature control apparatus.

FIG. 1 is a cross-sectioned elevational view showing a high-resolution color printer 10 for pressure-sensitive and temperature-sensitive recording using an embodiment of a temperature control apparatus. The color printer 10 comprises a thermal head 30, platen rollers 41, 42 and 43, and spring units 51, 52 and 53. The color printer 10 is a line printer for recording a full-color image line by line on a recording sheet 20 that includes cyan, magenta and yellow micro-capsules.

The color printer 10 comprises a housing 11, which is rectangular parallelepiped in a longitudinal direction ("line direction", hereinafter) being perpendicular to a longitudinal direction of the recording sheet 20. An inlet slit 12 is provided on an upper surface of the housing 11 for inserting the recording sheet 20, and an outlet slit 13 is provided in a right side surface of the housing 11. The recording sheet 20 passes along a conveyer path (single-chained line coinciding with the recording sheet 20) from the insert slit 12 to the outlet slit 13. The thermal head 30 extends along the conveyer path under the platen rollers 41, 42 and 43. A series of heating elements 31, a series of heating elements 32 and a series of heating elements 33 are provided on an upper surface of the thermal head 30 corresponding to the platen rollers 41, 42 and 43, respectively.

Figure 2:
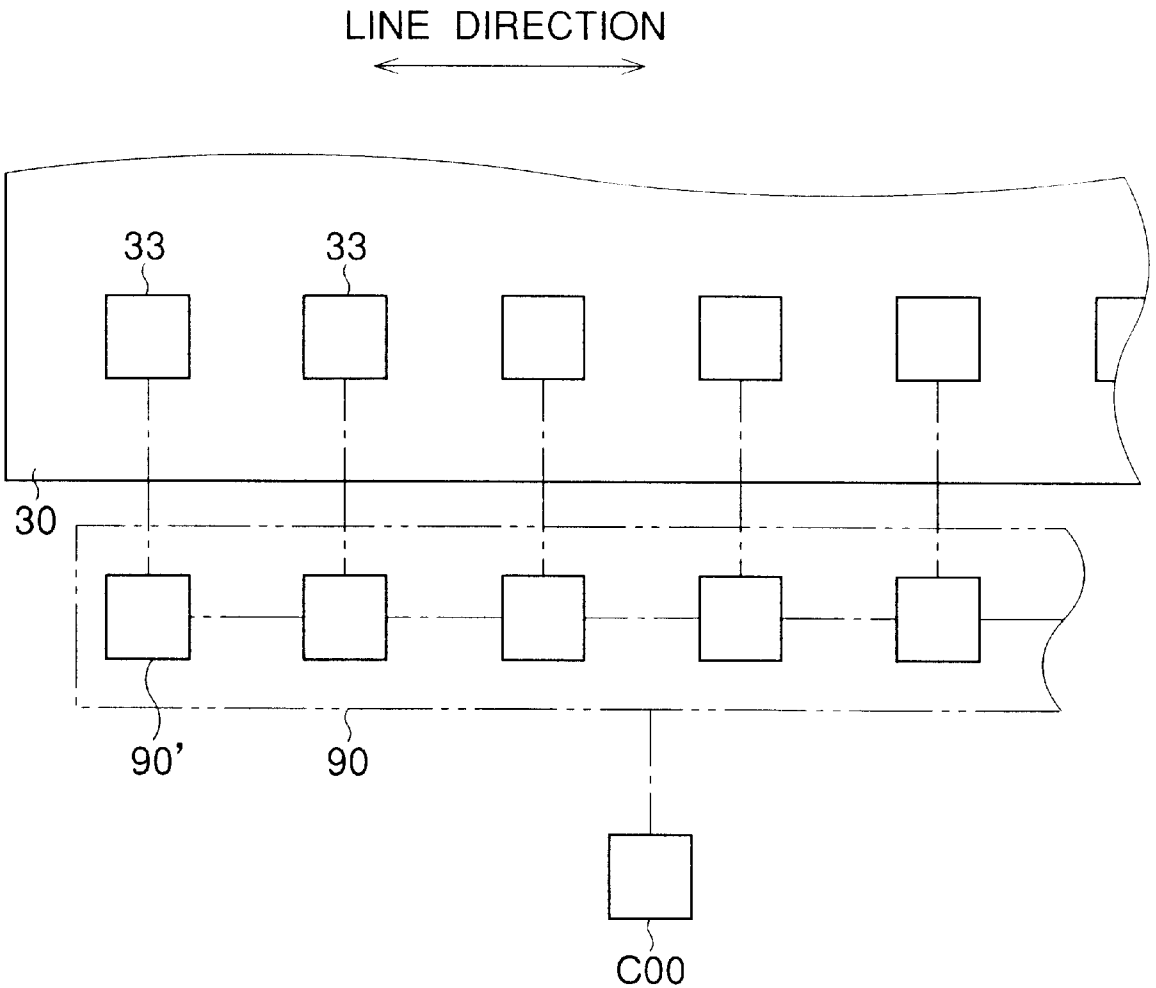
FIG. 2 is a plan view showing a thermal head viewed from a platen roller in FIG. 1.

FIG. 2 is a plan view of the thermal head 30, representatively showing the series of heating elements 33, viewed from the platen roller 43. The series of heating elements 33 are aligned along a line direction. Similarly, the series of heating elements 31 and the series of heating elements 32 are also aligned along the line direction.

The heating elements 33 are heated by a driver unit 90, which includes a plurality of temperature control apparatuses 90' corresponding to the heating elements 33, respectively. The temperature control apparatuses 90' are controlled by a control circuit C00 mounted on a printed circuit board (PCB) 62 (FIG. 1). The heating elements (31, 32, 33) of each series are selectively heated by the temperature control apparatuses 90', and each series of heating elements 31, 32 and 33 is heated to a different temperature.

The platen rollers 41, 42 and 43 are rubber rollers extending in the line direction for pressing the total width of the recording sheet 20 at the positions corresponding to the heating elements 31, 32 and 33, respectively. The platen rollers 41, 42 and 43 are resiliently biased toward the thermal head 30 and exert different predetermined pressures on the thermal head 30, by means of the spring units 51, 52 and 53, respectively. The platen rollers 41, 42 and 43 press with the different pressures at the positions of the heating elements 31, 32 and 33 uniformly along the total width of the recording sheet 20. The platen rollers 41, 42 and 43 are rotationally driven by motors (not shown), at respective predetermined speeds in a counterclockwise direction in FIG. 1. The recording sheet 20 is thus conveyed downstream toward the outlet opening 13 by the rotating platen rollers 41, 42 and 43 along the conveyer path. The motor is driven by a driver circuit (not shown) formed on the PCB 62.

The heating elements 31, 32 and 33, and the platen rollers 41, 42 and 43 correspond to three primary colors cyan, magenta and yellow. When the heating elements 31 operate in conjunction with the platen roller 41, the color cyan is developed; when the heating elements 32 operate in conjunction with the platen roller 42, the color magenta is developed; when the heating elements 33 operate in conjunction with the platen roller 43, the color yellow is developed. A number of series of heating elements and a number of platen rollers are changed in accordance with a number of types of micro-capsule.

When the recording sheet 20 is inserted from the insert slit 12 into the housing 11 on the conveyer path, the recording sheet 20 is conveyed by the platen rollers 41, 42 and 43 at a predetermined speed toward the outlet slit 13. During the movement, the recording sheet 20 is selectively heated by the heating elements 31, 32 and 33, as well as being pressed by the platen rollers 41, 42 and 43 against the thermal head 30 at the positions of the heating elements 31, 32 and 33. Image pixels are formed on the recording sheet 20 where the selective heat is directed. Then, the recording sheet 20 is forwarded through the outlet slit 13, being ejected from the housing 11.

The temperatures of the heating elements 31, 32 and 33 are set to increase in order. The temperature of the heating elements 32 is higher than the temperature of the heating elements 31, and the temperature of the heating elements 33 is higher than the temperature of the heating elements 32. Since the above serial color printer 10 performs the recording operation as the recording sheet 20 moves downstream, by using the above arrangement, the temperatures of the heating elements 32 and 33 are readily obtainable by additional heating of the heating elements 32 and 33, respectively, thus simplifying a thermal control of the heating elements 31, 32 and 33. Conversely, the pressures exerted by the platen rollers 41, 42 and 43 are set to decrease in order, that is, the pressure exerted by the platen roller 41 is lower than the pressure exerted by the platen roller 42, and the pressure exerted by the platen roller 43 is lower than the pressure exerted by the platen roller 42.

A battery 63, acting as a voltage source for the control circuit and so forth, is held in a compartment at a side opposite to the surface of the outlet opening 13.

Figure 3:
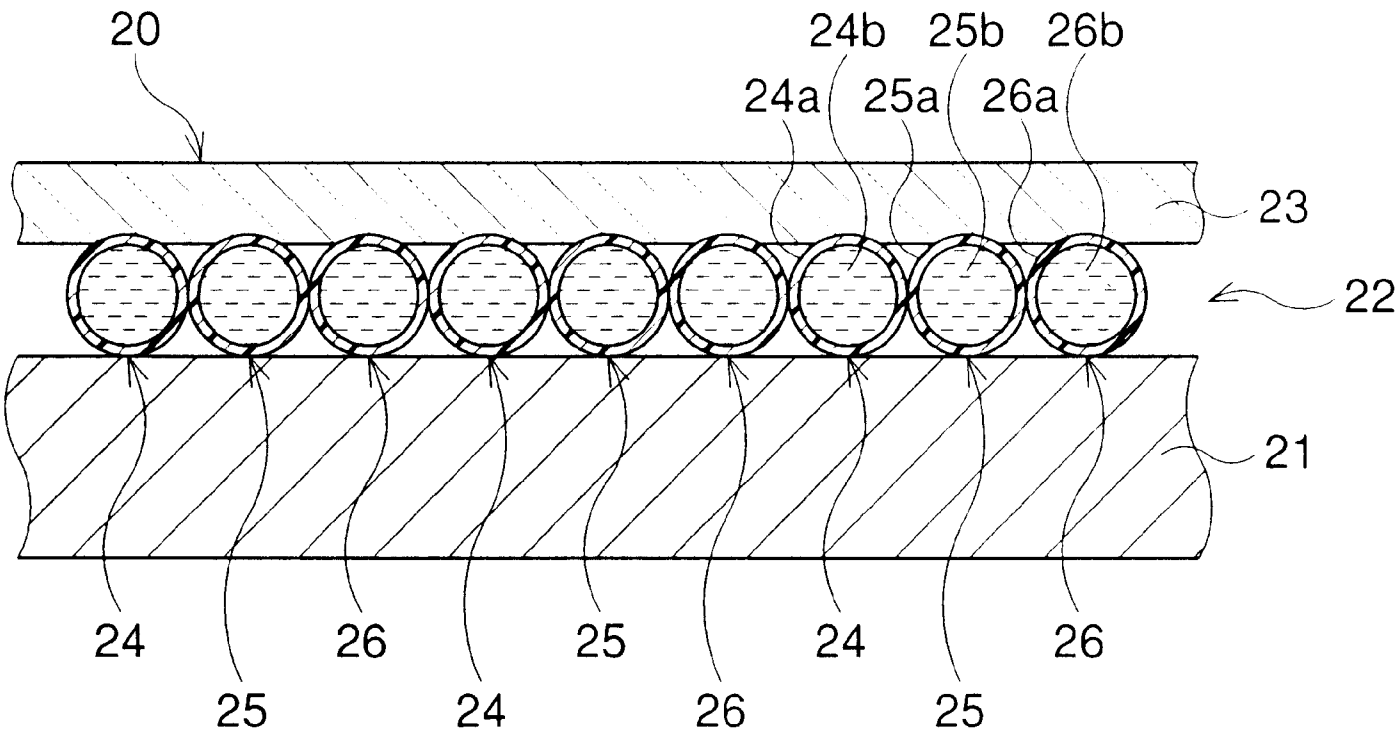
FIG. 3 is a cross-sectioned elevational view of a recording sheet used in the printer.

A structure of the recording sheet 20 is described with reference to FIG. 3., which is a cross-sectioned elevational view of the recording sheet 20.

The recording sheet 20 comprises a base member 21 made of white paper, a layer of micro-capsules 22, and a sheet of protective transparent film 23 covering the layer of micro-capsules 22.

The layer of micro-capsules 22 is formed from three types of micro-capsules: a first type of micro-capsules 24 each of which includes a shell wall 24*a* filled with a cyan core material 24*b*, a second type of micro-capsules 25 each of which includes a shell wall 25*a* filled with a magenta core material 25*b*, a third type of micro-capsules 26 each of which includes a shell wall 26*a* filled with a yellow core material 26*b*. The core materials 24*b*, 25*b* and 26*b* are liquid dyes or inks for developing the colors of cyan, magenta and yellow, respectively. The micro-capsules 24, 25 and 26 are uniformly distributed in the layer of micro-capsules 22 and adhered by a wax-based binder (fixing material). Shell walls 24*a*, 25*a* and 26*a* of the micro-capsules 24, 25 and 26 are of diameters of several micro-meters and are formed of a synthetic resin material. The transparent film 23 prevents the image formed on the recording sheet 20 from discoloration and fading due to ultra-violet radiation, oxidation. In FIG. 3, for the convenience of illustration, although the capsule layer 22 is shown as having a thickness corresponding to the diameter of the micro-capsules 24, 25 and 26, in reality, the three types of micro-capsules 24, 25 and 26 may overlay each other, and thus the capsule layer 22 may have a larger thickness than the diameter of a single micro-capsule 24, 25 or 26.

Figure 4:
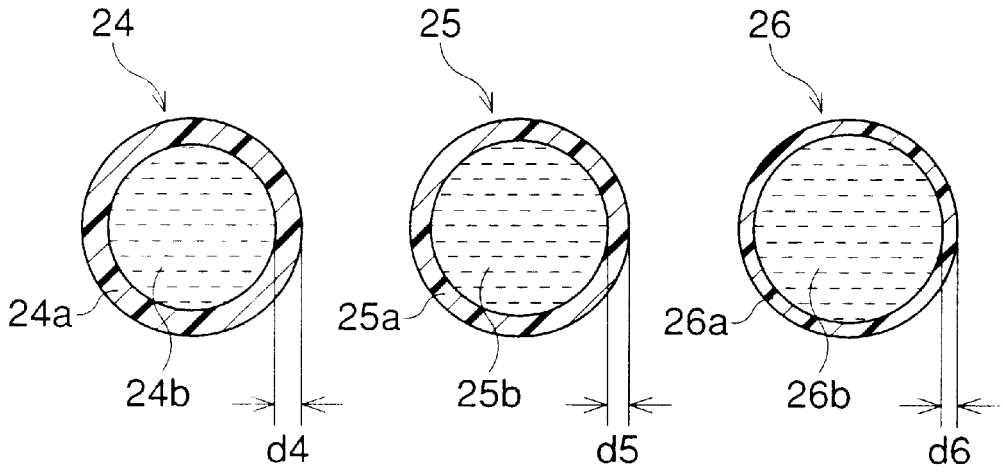
FIG. 4 is a cross-sectional view showing different types of micro-capsules utilized in the embodiment.
Figure 5:
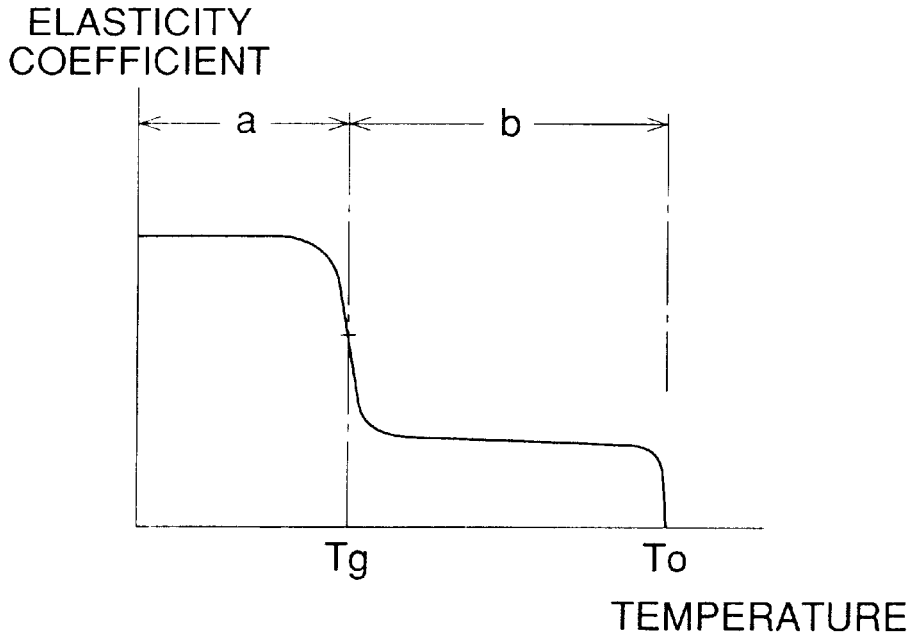
FIG. 5 is a graph showing a characteristic relationship between temperature and elasticity coefficient of a shape memory resin of the micro-capsules.

In FIG. 4, the three types of micro-capsules 24, 25 and 26 consist of shell walls 24*a*, 25*a* and 25*a*, respectively, and respective core materials 24*b*, 25*b* and 26*b*, respectively. The synthetic resin material of the walls 24*a*, 25*a* and 26*a* is a white shape memory resin, for example, polynorbornene, trans-1, 4-polyisoprene, polyurethane and so forth. In general, as shown in a graph of FIG. 5, the shape memory resin exhibits a coefficient of longitudinal elasticity, which abruptly changes at a glass-transition temperature boundary Tg. In the shape memory resin, micro-Brownian motion is frozen in a low temperature area "a", which is lower than the glass-transition temperature Tg, and thus the shape memory resin exhibits a glass-like phase. On the other hand, micro-Brownian motion of the molecular chain becomes increasingly energetic in a high-temperature area "b", which is higher than the glass-transition temperature Tg, and thus the shape memory resin exhibits a rubber elasticity.

Figure 6:
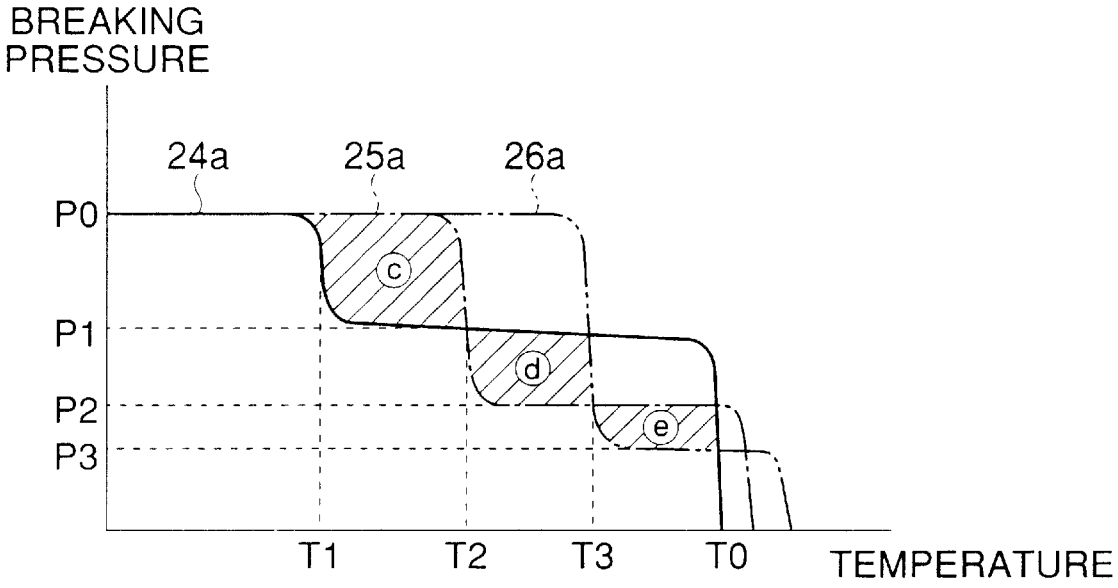
FIG. 6 is a graph showing a characteristic relationship between glass-transition temperature and breaking pressure of a capsule wall of the different types of micro-capsules.

As shown in a graph of FIG. 6, the micro-capsule wall 24*a* is prepared so as to exhibit a characteristic breaking pressure having a glass-transition temperature T1; the micro-capsule wall 25*a* is prepared so as to exhibit a characteristic breaking pressure having a glass-transition temperature T2; and the micro-capsule wall 26*a* is prepared so as to exhibit a characteristic breaking pressure having a glass-transition temperature T3. For example, the glass-transition temperature T1 may be set to a temperature selected from a range between 65° C. and 70° C., and the temperatures T2 and T3 are set so as to increase in turn by 40° C. from the temperature set for T1. In this embodiment, the glass-transition temperatures T1, T2 and T3 are 65° C., 105° and 145° C., respectively.

Note, by suitably varying compositions of the shape memory resin and/or by selecting a suitable one from among various types of shape memory resin, it is possible to obtain the respective shape memory resins, with the glass-transition temperatures T1, T2 and T3.

In FIG. 4, the wall thickness d4 of cyan micro-capsules 24 is larger than the wall thickness d5 of magenta micro-capsules 25, and the wall thickness d5 of magenta micro-capsules 25 is larger than the wall thickness d6 of yellow micro-capsules 26. Consequently, the breaking pressure increases as the wall thickness (d4, d5, d6) increases.

As shown in FIG. 6, the wall thickness d4 of the cyan micro-capsule wall 24*a* is selected such that it is broken and compacted under a breaking pressure that lies between a critical breaking pressure P1 and an upper limit pressure P0, when each micro-capsule 24 is heated to a temperature between the glass-transition temperatures T1 and T2, as shown by a hatched area "c"; the wall thickness d5 of the magenta micro-capsule wall 25*a* is selected such that it is broken and compacted under a breaking pressure that lies between a critical breaking pressure P2 and the critical breaking pressure P1, when each micro-capsule 25 is heated to a temperature between the glass-transition temperatures T2 and T3, as shown by a hatched area "d"; the wall thickness d6 of the yellow micro-capsule wall 26*a* is selected such that each yellow micro-capsule 26 is broken and compacted under a breaking pressure that lies between a critical breaking pressure P3 and the critical breaking pressure P2, when each micro-capsule 26 is heated to a temperature between the glass-transition temperature T3 and an upper limit temperature T0 as shown by a hatched area "e".

Note, when the glass-transition temperatures T1, T2, T3 are set as mentioned above, the upper limit temperature T0 may be set to a temperature selected from a range between 185° C. and 190° C. Also, the critical breaking pressures P3 may be, for example, 0.02 MPa; the critical breaking pressure P2 may be, for example, 0.2 MPa; the critical breaking pressure P1 may be, for example, 2.0 MPa; and the upper limit pressure P0 may be, for example, 20 MPa.

For example, if the selected heating temperature and breaking pressure fall within a hatched cyan area "c", as shown in FIG. 6, only the cyan micro-capsules 24 are broken and squashed. Also, if the selected heating temperature and breaking pressure fall within the hatched magenta area "d", only the magenta micro-capsules 25 are broken and squashed. Further, if the selected heating temperature and breaking pressure fall within the hatched yellow area "e", only the yellow micro-capsules 26 are broken and squashed. Then, the recording sheet 20 is colored by the corresponding dye or ink for forming the color image.

Figure 8:
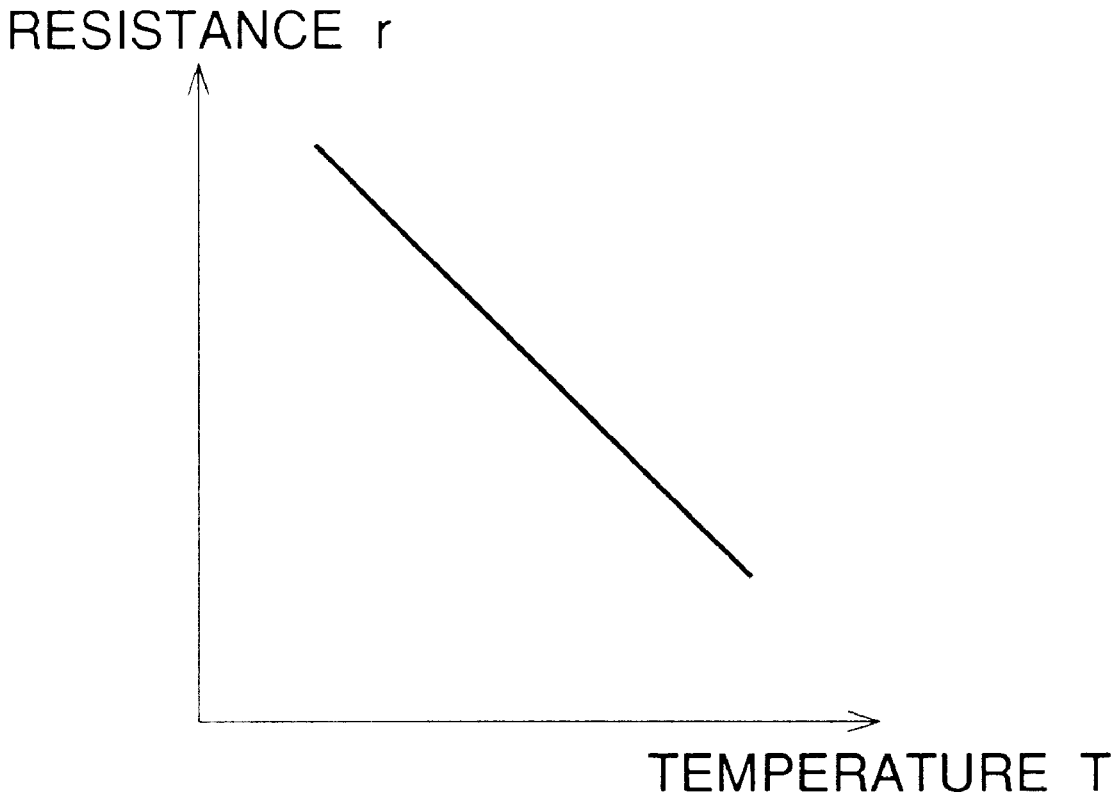
FIG. 8 is a graph showing a characteristic relationship between temperature and resistance of the heating resistor.
Figure 9:
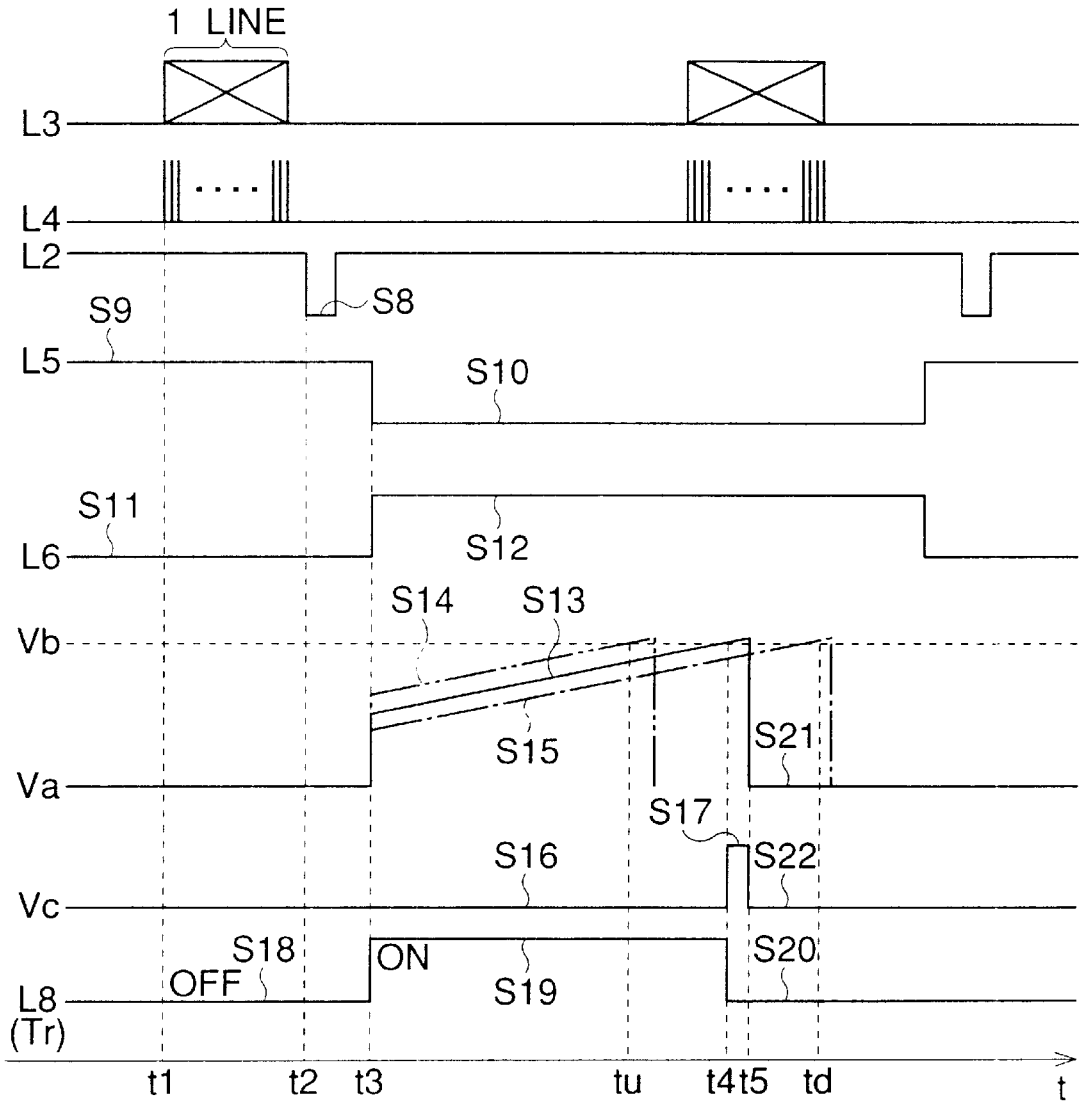
FIG. 9 is a timing chart of an operation of the temperature control apparatus.

The temperature control apparatus 90' in the driver unit 90 (FIG. 2) is now described in detail with reference to FIGS. 7 to 9.

Figure 7:
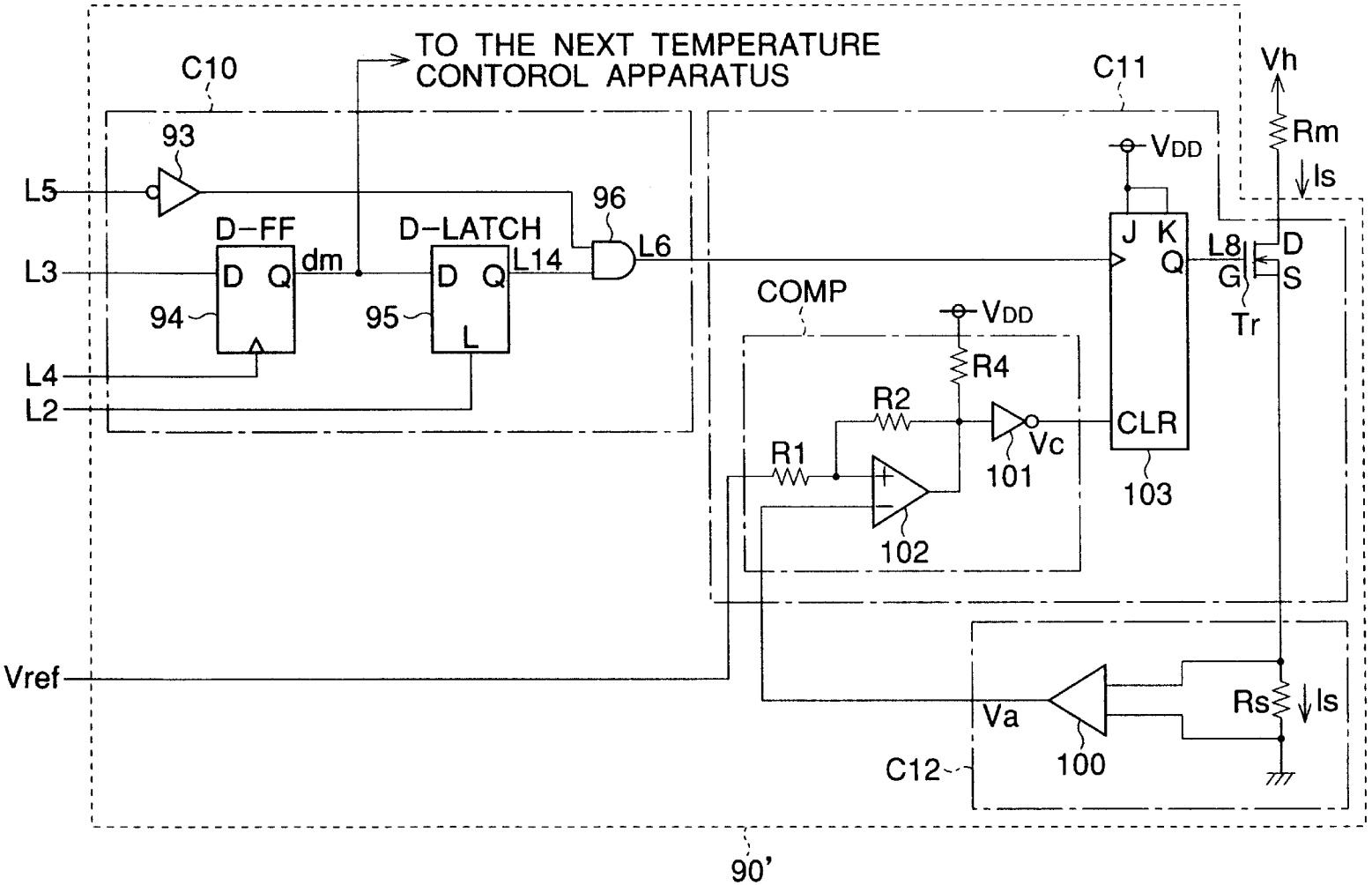
FIG. 7 is a block diagram showing a temperature control apparatus of the embodiment according to the present invention.

FIG. 7 is a block diagram showing the temperature control apparatus 90'. The color printer 10 forms the image line by line and a number of each of heating elements 31, 32 and 33 corresponds to a number of pixels of one line. The heating elements 31, 32 and 33 are heating resistors, and, herein, an $m^{th}$ heating element 33 is designated by a reference "Rm". A characteristic relationship between temperature T (corresponding to T3) and resistance r of the heating resistor Rm is shown in FIG. 8. The temperature coefficient in FIG. 8 is negative, that is, the resistance lowers as the temperature rises. Although the following description refers to the temperature control apparatus 90' of a heating element 33 (FIG. 2), obviously the description is applicable to the heating elements 31 and 32.

The heating resistor Rm has opposite terminals, one of which is connected to a power supply of a constant direct voltage Vh, and the other of which is connected to the temperature control apparatus 90'. Signals L2, L3, L4 and L5 and a reference voltage Vref are input to the temperature control circuit 90'. The signal L3 is a data of pixels in one line of an image to be recorded. The signal L2 is a latch signal for receiving the data signal L3 at a proper timing. The signal L4 is a data-extracting signal operating synchronously with the latch signal L2 for extracting the data signal L3 for each heating resitor Rm.

The temperature control apparatus 90' includes a current sensor 100, which is connected to the heating resistor Rm through a sensing resistor Rs and a switching device Tr. The current sensor 100 is a differential amplifier, for example. The switching device Tr is an nMOS, for example, having a drain D and a source S connected to the resistors Rm and Rs, respectively. When the switching device Tr is closed, a current Is through the heating resistor Rm is introduced to the sensing resistor Rs, causing a voltage drop between opposite terminals of the sensing resistor Rs. The current sensor 100 amplifies the voltage drop to a proper level and outputs an analog signal Va corresponding to the voltage drop. A sensing circuit C12 incorporates the sensing resistor Rs and the current sensor 100. Since the resistance of the heating resistor Rm decreases as the temperature rises, the analog signal Va increases as the temperature increases. When the signal Va exceeds a threshold value the switching device Tr is opened, as mentioned below.

The analog signal Va is input to a temperature control circuit C11, which includes a comparator COMP and a holding circuit. The comparator COMP includes an operational amplifier 102, an inverter 101, first resistor R1, second resistor R2 and a pull-up resistor R4 which is connected to a supplied voltage VDD. The analog signal Va is input to the comparator COMP, and an output Vc of the comparator COMP is input to a clear input of a JK-flip-flop 103 being the holding circuit. The JK-flip-flop 103 holds and outputs a status signal (switching signal) L8 to an input G of the switching device Tr for opening and closing the switching device Tr. The reference voltage Vref is connected through the first resistor R1 to a non-inverted input of the operational amplifier 102, and the second resistor R2 is connected between the non-inverted input and an output of the operational amplifier 102. The analog signal Va is input to an inverted input of the operational amplifier 102. When the analog signal Va exceeds a threshold value Vb, which is based on the reference voltage Vref and is defined by the following formula (1), the inverter 101 outputs the signal Vc, being low level, to CLR so as to clear the data in the JK-flip-flop 103. Thus, the status signal L8 becomes low level and the switching device Tr opens.

$$Vb = \frac{V_{DD} \cdot R1}{R1 + R2} + \frac{Vref \cdot R2}{R1 + R2} \quad (1)$$

Therefore, the threshold value Vb is adjustable by the resistors R1 and R2.

The temperature control circuit C11 is controlled by a clock generating circuit C10. The signals L3 and L4 are input to a data input D and a clock input of a D-flip-flop 94, which extracts data dm from a total data series for the total resistors (Rm) corresponding to the total pixels of one line, indicating that heating is to be performed by the resistor Rm. The extracted data dm is held by a D-flip-flop 95 connected at a data input D to a data output Q of the D-flip-flop 94. The output from the data output Q of the D-flip-flop 94 is also transferred to the next temperature control circuit 90' of the resistor Rm+1. The signal L5 is inverted by an inverter 93 and input to an AND-gate 96. An output L14 of D-flip-flop 95 is also input to the AND-gate 96. An output L6 of the AND-gate 96 is input to a clock input of the JK-flip-flop 103 of the temperature control circuit C11.

When the data dm is held by the D-flip-flop 95 for heating the heating resistor Rm, and the signal L5 is low level, the clock output L6 from the AND-gate 96 becomes high level. Therefore, when the data dm and the strobe signal L5 indicate that the resistor Rm is to be heated and, simultaneously, the strobe signal L5 is low (L6 is high), the JK-flip-flop 103 receives a high level clock signal L6. At this time, if the output of the comparator COMP is high, the switching device Tr is closed so that the heating resistor Rm is heated. Otherwise, the switching device Tr is opened so that the heating is stopped.

An operation of the temperature control apparatus 90' is now described with reference to a timing chart in FIG. 9.

At time "t1", the digital image-pixel signal L3 of one pixel line and the data extracting signal L4 are input to the D-flip-flop 94 of the temperature control apparatus 90'. The D-flip-flop 94 extracts the data dm indicating whether the heating resistor Rm is to be heated. The extracted data dm is held by the D-latch 95. When the latch signal L2 becomes low for a short time, as shown by reference S8, at time "t2", the output L14 (not shown in FIG. 9 ) of the D-flip-flop 95 is kept high.

At time "t3", the strobe signal L5 (S9) becomes low (S10), and the inversion L6 (S11) becomes high(S12). Then the signal L8 (S18) becomes high (S19) so that the switching device Tr (OFF) is closed (ON), and the heating of the heating resistor Rm is started. As the temperature rises, the signal Va gradually increases, as shown by a reference S13. When the signal Va exceeds the threshold value Vb based on the reference voltage Vref at time "t4", the signal Vc (S16) becomes high (S17), and L8 becomes low, as shown by S20, by opening the switching device Tr. The current Is (FIG. 7) is stopped and the signals Va and Vc become low level as shown by S21 and S22, respectively, at time "t5".

The temperature control apparatus 90' of the present invention is easily adaptable to environmental ambient changes and heat hysterisis, for example, if the heating resister Rm is rather hot before the heating, the signal Va may be higher, as shown by S14, than "Va" shown by S13, and the signal Va will reach the threshold value Vb at time "tu" being prior to "t4". If the heating resister Rm is cold before the heating, the signal Va may be lower, as shown by S15, than "Va" shown by S13, and the signal Va will reach the threshold value Vb later at time "td" after "t4". Therefore, no significant effect occurs, and the temperature control apparatus 90' operates without difficulty.

In the above embodiment, the temperature of the heating resistor Rm can be measured from the current Is, flowing through the heating resistor Rm. Thus, a more accurate control can be realized than that in the prior art.

The resistors R1, R2 and R4 are adjusted, so that the relationship between the temperature and the current is optimized.

The heating temperature (T1, T2 and T3 ) of the heating resistor Rm of the heating elements 31, 32 and 33 may be controlled by changing the reference voltage Vref. It is also possible that the reference voltages Vref for the heating elements 31, 32 and 33 are equal and the heating temperature (T1, T2 and T3) of the heating resistor Rm of the heating elements 31, 32 and 33 is controlled by the threshold value Vb which is adjusted by the resistors R1 and R2, respectively.

In the above embodiment, the temperature coefficient of the heating resistor Rm is negative, however, it is also possible to use a heating resistor of a positive temperature coefficient. In this case, the differential amplifier of the current sensor 100 is substituted by an inverting amplifier.

Finally, it will be understood by those skilled in the art that the foregoing description is of a preferred embodiment of the temperature control apparatus, and that various changes and modifications may be made to the present invention without departing from the spirit and scope thereof.

The present disclosure relates to subject matters contained in Japanese Patent Application No.10-096590 (filed on Mar. 25, 1998) which is expressly incorporated herein, by reference, in its entirety.

What is claimed is:

1. A temperature control apparatus that controls a temperature of a heating resistor in a heating element of a recording apparatus, said heating element heating at least one micro-capsule corresponding to a pixel of an image, the micro-capsule having a shell wall and filled with a color-developing dye, the micro-capsule adapted to break when the micro-capsule is heated to a predetermined temperature and subjected to a predetermined pressure, said heating element further having positive temperature coefficient, the heating element being positioned so as to face a roller that applies the predetermined pressure on the micro-capsule by pushing the micro-capsule against the heating element, the temperature control apparatus comprising:

a sensing circuit that includes a sensing resistor connected in series to said heating resistor that senses a current flowing in said heating resistor and outputs an analog signal indicating the temperature in accordance with the current, said sensing resistor having opposite terminals; and a temperature control circuit that includes a switching device that switches said current and a holding circuit that holds a status signal indicating whether said heating resistor is to be heated, said switching device being switched by said holding circuit in accordance with said status signal, said status signal held in said holding circuit being cleared when said analog signal exceeds a predetermined threshold value, which is higher than the predetermined temperature, said temperature control circuit further comprising a comparator that compares said analog signal to a threshold value and outputs a clearing signal that clears said status signal;

wherein the predetermined pressure and the predetermined temperature are simultaneously applied to the at least one micro-capsule by said roller and said heating resistor when the status signal indicates that the heating resistor is to be heated;

wherein the at least one micro-capsule comprises a plurality of micro-capsules of a plurality of primary colors, each of the plurality of micro-capsules of each of the plurality of primary colors having different predetermined temperatures and different predetermined pressures;

said heating resistor comprises a plurality of heating elements. each corresponding to one of said plurality of micro-capsules of said plurality of primary colors and said threshold value of each of said plurality of heating elements being different from each other, said roller comprising a plurality of rollers that respectively face one of said plurality of heating elements and respectively apply the different predetermined pressures on each of said plurality of micro-capsules by pushing each of said plurality of micro-capsules against a respective one of said plurality of heating elements, and each of said plurality of micro-capsules being broken when one of the predetermined pressures and one of the predetermined temperatures corresponding to each of said plurality of micro-capsules are applied simultaneously.

2. The temperature control apparatus of claim 1, wherein said sensing circuit further comprises a current sensor that amplifies a voltage between said opposite terminals of said sensing resistor, such that a relationship between said temperature and said analog signal is adjustable.

3. The temperature control apparatus of claim 1, wherein said comparator comprises an operational amplifier that receives said analog signal at an inverted input and a reference voltage at a non-inverted input and compares said analog signal to said threshold value based on said reference voltage, a first resistor connecting said reference voltage to said non-inverted input of said operational amplifier, and a second resistor connected between said non-inverted input and an output of said operational amplifier, said operational amplifier comparison being adjustable by said first and second resistors.

4. The recording apparatus of claim 1, wherein said plurality of micro-capsules includes three micro-capsules, said plurality of primary colors comprising three primary colors, the three micro-capsules of the three primary colors having different predetermined temperatures and different predetermined pressures, said plurality of heating elements comprises three heating elements, each corresponding to one of the three micro-capsules of three primary colors and said threshold value of each of the three heating elements being different from each other, said plurality of rollers comprising three rollers that respectively face the three heating elements and respectively apply the different predetermined pressures on the three micro-capsules by pushing the three micro-capsules against the three heating elements, and each of the three micro-capsules is broken when one of the predetermined pressures and one of the predetermined temperatures corresponding to each of the three micro-capsules are applied simultaneously.

5. The temperature control apparatus of claim 1, further comprising a clock generating circuit that extracts a data corresponding to each pixel from a data series of one pixel line of an image and outputs said status signal, based on said data, to said holding circuit of said temperature control circuit.

6. The temperature control apparatus of claim 1, wherein said heating resistor comprises a temperature/resistance characteristic such that a resistance of said heating resistor changes depending on said temperature of said heating resistor and said current corresponds to said temperature of said heating resistor.

7. A recording apparatus comprising:

a heating resistor that heats at least one micro-capsule corresponding to a pixel of an image, the micro-capsule having a shell wall and filled with a color-developing dye, the micro-capsule adapted to break when the micro-capsule is heated to a predetermined temperature and subjected to a predetermined pressure;

a roller that applies the predetermined pressure on the at least one micro-capsule by pushing the micro-capsule against said heating resistor;

a temperature control apparatus that receives a status signal indicating whether said heating resistor is to be heated and controls a temperature of said heating resistor, said temperature control apparatus comprising:

a sensing circuit that includes a sensing resistor connected in series to said heating resistor that senses a current flowing in said heating resistor and outputs an analog signal indicating temperature in accordance with the current, said sensing resistor having opposite terminals; and a temperature control circuit that includes a switching device that switches said current and a holding circuit that holds said status signal being switched by said holding circuit in accordance with said status signal, said status signal held in said holding circuit being cleared when said analog signal exceeds a predetermined threshold value, which is higher than the predetermined temperature, said temperature control circuit further comprises a comparator that compares said analog signal to a threshold value and outputs a clearing signal that clears said status signal;

wherein the predetermined pressure and the predetermined temperature are simultaneously applied to the at least one micro-capsule corresponding to the pixel by said heating resistor and said roller when the status signal indicates that the heating resistor is to be heated;

wherein the at least one micro-capsule includes a plurality of micro-capsules of a plurality of primary colors, each of said plurality of micro-capsules of each of said plurality of primary colors having different predetermined temperatures and different predetermined pressures, said heating resistor comprises a plurality of heating elements, each corresponding to one of said plurality of micro-capsules of said plurality of primary colors and said threshold value of each of said plurality of heating elements being different from each other;

said roller comprising a plurality of rollers that respectively face one of said plurality of heating elements and respectively apply the different predetermined pressures on each of said plurality of micro-capsules by pushing each of said plurality of micro-capsules against a respective one of said plurality of heating elements, and each of said plurality of micro-capsules being broken when one of the predetermined pressures and one of the predetermined temperatures corresponding to each of said plurality of micro-capsules are applied simultaneously.

8. The recording apparatus of claim 7, wherein said heating resistor further comprises a positive temperature coefficient.

9. The recording apparatus of claim 7, wherein said comparator comprises:

an operational amplifier that receives said analog signal at an inverted input and a reference voltage at a non-inverted input and compares said analog signal to said threshold value based on said reference voltage a first resistor connecting said reference voltage to said non-inverted input of said operational amplifier; and a second resistor connected between said non-inverted input and an output of said operational amplifier, said operational amplifier comparison being adjustable by said first and second resistors.

10. The recording apparatus of claim 7, wherein said plurality of micro-capsules includes three micro-capsules, said plurality of primary colors comprising three primary colors, the three micro-capsules of three primary colors having different predetermined temperatures and different predetermined pressures, said plurality of heating elements comprising three heating elements, each corresponding to one of the three micro-capsules of three primary colors and said threshold value of each of the three heating elements being different from each other, said plurality of rollers comprising three rollers that respectively face the three heating elements and respectively apply the different predetermined pressures on the three micro-capsules by pushing the three micro-capsules against the three heating elements, and each of the three micro-capsules is broken when one of the predetermined pressures and one of the predetermined temperatures corresponding to each of the three micro-capsules are applied simultaneously.

11. A heating element of a recording apparatus comprising:

a heating resistor that heats at least one micro-capsule having a shell wall and filled with a color-developing dye, the micro-capsule adapted to break when the micro-capsule is heated to a predetermined temperature and subjected to a predetermined pressure;

a temperature control apparatus that controls a temperature of said heating resistor, said temperature control apparatus comprising:

a sensing circuit that includes a sensing resistor connected in series to said heating resistor, that senses a current flowing in said heating resistor and that outputs an analog signal indicating temperature in accordance with the current, said sensing resistor having opposite terminals; and a temperature control circuit that includes a switching device that switches said current and a holding circuit that holds a status signal indicating whether said heating resistor is to be heated, said switching device being switched by said holding circuit in accordance with said status signal, said status signal held in said holding circuit being cleared in accordance with said analog signal, said temperature control circuit further comprising a comparator that compares said analog signal to a threshold value and outputs a clearing signal that clears said status signal; and wherein the heating element faces a roller that applies the predetermined pressure on the micro-capsule by pressing the micro-capsule against the heating resistor, and the predetermined pressure and the predetermined temperature are simultaneously applied to the at least one micro-capsule corresponding to the pixel by said heating resistor and said roller when the status signal indicates that the heating resistor is to be heated;

wherein the at least one micro-capsule includes a plurality of micro-capsules of a plurality of primary colors. each of said plurality of micro-capsules of each of said plurality of primary colors having different predetermined temperatures and different predetermined pressures, said heating resistor comprises a plurality of heating elements, each corresponding to one of said plurality of micro-capsules of said plurality of primary colors and said threshold value of each of said plurality of heating elements being different from each other;

said roller comprising a plurality of rollers that respectively face one of said plurality of heating elements and respectively apply the different predetermined pressures on each of said plurality of micro-capsules by pushing each of said plurality of micro-capsules against a respective one of said plurality of heating elements, and each of said plurality of micro-capsules being broken when one of the predetermined pressures and one of the predetermined temperatures corresponding to each of said plurality of micro-capsules are applied simultaneously.

12. The heating element of claim 11, further comprising a positive temperature coefficient.

13. The heating element of claim 11, wherein said comparator comprises:

an operational amplifier that receives said analog signal at an inverted input and a reference voltage at a non-inverted input and compares said analog signal to said threshold value based on said reference voltage a first resistor connecting said reference voltage to said non-inverted input of said operational amplifier; and a second resistor connected between said non-inverted input and an output of said operational amplifier, said operational amplifier comparison being adjustable by said first and second resistors.

14. The recording apparatus of claim 11, wherein said plurality of micro-capsules includes three micro-capsules, said plurality of primary colors comprising three primary colors, the three micro-capsules of three primary colors having different predetermined temperatures and different predetermined pressures, said plurality of heating elements comprises three heating elements, each corresponding to one of the three micro-capsules of three primary colors and said threshold value of each of the three heating elements being different from each other said plurality of rollers comprising three rollers that respectively face the three heating elements and respectively apply the different predetermined pressures on the three micro-capsules by pushing the three micro-capsules against the three heating elements, and each of the three micro-capsules is broken when one of the predetermined pressures and one of the predetermined temperatures corresponding to each of the three micro-capsules are applied simultaneously.

* * * * *